US006798383B2

(12) United States Patent
Nakase et al.

(10) Patent No.: US 6,798,383 B2
(45) Date of Patent: Sep. 28, 2004

(54) LOW PROFILE SMALL ANTENNA AND CONSTRUCTING METHOD THEREFOR

(75) Inventors: Kazuhiko Nakase, Tokyo (JP); Koutarou Kojima, Tokyo (JP); Nobuhito Ebine, Tokyo (JP); Katsuki Hirabayashi, Tokyo (JP); Kuniaki Hirahaya, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/240,704

(22) PCT Filed: Jan. 18, 2002

(86) PCT No.: PCT/JP02/00341

§ 371 (c)(1),
(2), (4) Date: Apr. 1, 2003

(87) PCT Pub. No.: WO02/063719

PCT Pub. Date: Aug. 15, 2002

(65) Prior Publication Data

US 2003/0160727 A1 Aug. 28, 2003

(30) Foreign Application Priority Data

Feb. 5, 2001 (JP) ..... 2001-028883
Aug. 13, 2001 (JP) ..... 2001-245430

(51) Int. Cl.[7] ..... H01Q 1/38

(52) U.S. Cl. ..... 343/700 MS; 343/725; 343/895

(58) Field of Search ..... 343/700 MS, 702, 343/725, 895, 893

(56) References Cited

U.S. PATENT DOCUMENTS

| | | | | |
|---|---|---|---|---|
| 4,849,765 | A | 7/1989 | Marko | 343/702 |
| 5,434,579 | A | 7/1995 | Kagoshima et al. | 343/700 MS |
| 5,760,746 | A | 6/1998 | Kawahata | 343/702 |
| 6,005,521 | A * | 12/1999 | Suguro et al. | 343/700 MS |

FOREIGN PATENT DOCUMENTS

| | | |
|---|---|---|
| JP | 9-260934 | 10/1997 |
| JP | 2000-307340 | 11/2000 |

* cited by examiner

*Primary Examiner*—Shih-Chao Chen
(74) *Attorney, Agent, or Firm*—Frommer Lawrence & Haug LLP; William S. Frommer

(57) ABSTRACT

A built-in antenna applied to sending and reception of radio waves of a few giga cycles is improved and made smaller, and is made suitable for industrial production and has its tuning bandwidth widened. "An antenna pattern (6) which resonates at λ/4" is formed on a substrate (5) and a zigzag portion (6*a*) is provided on a portion of the antenna pattern (6) which resonates at λ/4. On the other hand, the substrate (5) and a bobbin (8) are supported by a metallic frame (7), and "a helical coil (9) which resonates at λ/4" is wound and formed upon the bobbin (8). Capacitance (c) is provided between the antenna pattern (6) which resonates at λ/4 and the helical coil (9) to electrically couple them.

17 Claims, 9 Drawing Sheets

(SWR CHARACTERISTIC GRAPH)

LOW PROFILE SMALL ANTENNA AND CONSTRUCTING METHOD THEREFOR

TECHNICAL FIELD

The present invention relates to a small built-in radio communication antenna which is small and light and which has excellent gain and broadband tuning characteristics, and, more particularly, to a small low-posture antenna that is suitable for industrial production.

BACKGROUND ART

A whip antenna which resonates at λ/2 is used as an antenna which sends and receives GHz (gigahertz) class radio waves.

However, when the mechanical length of a whip antenna is about 10 cm, it becomes difficult to handle. Therefore, it has often been used by making it stowable/extendable by forming it into an extendable type or a tilting-down type.

However, in a stowable/extendable type, not only is it troublesome to operate the antenna, but also the antenna may break due to collision with an external obstacle when the antenna is in an extended posture.

To overcome this problem, a built-in antenna which is made short to the order of λ/4, and which does not need to be extended/stowed has been developed. This technology has been created by the present inventor, and an application thereof is separately being filed by the present applicant (Japanese Patent Application No. 2000-237629). (This application will hereunder be referred to as "earlier application which is not yet publicly known.")

FIG. 9 is a schematic view which is drawn as FIG. 1 in the earlier application which is not yet publicly known.

A plate-shaped antenna 1 having an overall length of λ/4 is bent into an L shape, with an end 1*a* at a short side of the antenna 1 being mounted to and supported by a bottom plate 2.

On the other hand, an input end 3*b* of a λ/4 antenna exciter 3 is connected to an output end of a high-frequency circuit 4, and an open end 3*a* thereof opposes and is spaced from an open end 1*c* of the plate-shaped antenna 1 in order to provide an electrostatic coupling capacity c.

The antenna of the earlier application that is not yet publicly known, shown in FIG. 9, has an overall electrical length of λ/4, and its mechanical length can be decreased to less than λ/4. When this antenna is used as a built-in antenna, extending and contracting operations do not need to be carried out, so that this antenna is very convenient to use, and will not break when it collides with an external obstacle. In addition, since the antenna has wideband tuning characteristics and high gain, the antenna provides excellent characteristics.

After filing the application of the above-described invention that is not yet publicly known, the present inventor has promoted experiments and research for practical application. It has been confirmed that, even under practical conditions, the antenna provides the desired advantages. On the other hand, it has been found and confirmed that there is still room for improvement.

This room for improvement will be described below. In order for the antenna device to operate with good characteristics, it is necessary for the electrostatic coupling capacity c to be an appropriate value that realizes a critical coupling state, and for the parallelism and the interval between a long side of the plate-shaped antenna 1, formed into an L shape, and the bottom plate 2 to be proper values.

Under laboratory use conditions, the aforementioned requirements do not give rise to particular problems, but, when such antennas (FIG. 8) are industrially produced in large quantities, it is difficult to maintain uniformity in the qualities of many products (more specifically, the uniformity in the characteristics of the antennas).

This is because it is not easy to restrict with high precision the positions and the postures of such plate-shape antennas 1. which are bent into an L shape by punching out a metal plate into strips, when their short-side ends are mounted to the bottom plate 2.

Further, it is not easy to position with high precision the antenna exciter 3 with respect to the plate-shaped antenna 1.

The present invention has been achieved in view of the above-described problems, and has as its object the provision of a technology which, by improving the antenna of the earlier application which is not yet publicly known, is made suitable for maintaining uniformity in qualities in industrial production and makes it possible to further reduce the height (interval between a plate-shaped antenna and a bottom plate), without impairing characteristic features, such as smallness, not requiring extending and contracting operations, and high performance (particularly, wideband tuning characteristics).

DISCLOSURE OF INVENTION

A structure of a method of an invention of claim 1 created to achieve the aforementioned end is that of a method for forming an antenna which is tuned near a wavelength λ, wherein an antenna pattern which resonates at λ/4 is formed on a surface of a substrate, wherein the substrate is made to oppose and is supported with respect to a planar portion of a metallic frame, wherein a helical coil which resonates at λ/4 is supported by the metallic frame, wherein one end of the antenna pattern is connected to and is brought into electrical conduction with the metallic frame, and wherein one end of the helical coil and one end of the antenna pattern are made to oppose each other in order to provide capacitance and the other end of the helical coil is connected to an output end of a high-frequency circuit in order to make the helical coil act as an antenna exciter.

In addition to including the structural requirement of the invention of claim 1. a structure of a method of an invention of claim 2 includes a structural requirement in which, in means for connecting and bringing into electrical conduction the helical coil and the output end of the high-frequency circuit, a core wire of a coaxial cable is connected to and brought into electrical conduction with one end of the helical coil, and an external conductor is connected to and brought into electrical conduction with the metallic frame, and wherein the other end of the core wire of the coaxial cable is connected to the output end of the high-frequency circuit, and the external conductor is connected to a bottom plate of the high-frequency circuit.

A structure of a method of an invention of claim 3 is that of a method for forming an antenna which is tuned near a wavelength λ, wherein an antenna pattern which resonates at λ/4 is formed at one end of a surface of a substrate, wherein an exciter pattern which resonates at λ/4 is formed near the other end of the substrate, wherein the antenna pattern and the exciter pattern are made to oppose each other and to be spaced from each other in order to provide capacitance therebetween, wherein the substrate is supported by a metallic frame having a planar portion that opposes the substrate, and wherein one end of the exciter pattern is connected to an output end of a high-frequency circuit.

In addition to including the structural requirement of the invention of claim 3, a structure of a method of an invention of claim 4 includes a structural requirement in which, in means for connecting and bringing into electrical conduction the exciter pattern and the high-frequency circuit, a core wire of a coaxial cable is connected to and brought into electrical conduction with one end of the λ/4 exciter pattern and an external conductor is connected to and brought into electrical conduction with the metallic frame. and wherein the other end of the core wire of the coaxial cable is connected to the output end of the high-frequency circuit and the external conductor is connected to a bottom plate of the high-frequency circuit.

In addition to including the structural requirement of either claim 1 or claim 3, a structure of a method of an invention of claim 5 includes a structural requirement in which the antenna pattern generally has a strip shape and has a rectangular or zigzag portion formed on the substrate, and in which the substrate is supported by the metallic frame, and a portion near the zigzag portion is connected to and brought into electrical conduction with the metallic frame.

In addition to including the structural requirement of the invention of either claim 1 or claim 3, a structure of a method of an invention of claim 6 includes a structural requirement in which holes for inserting mounting screws are provided in both end portions of the metallic frame and the mounting screws that have been inserted into the holes are screwed into the bottom plate. so that the metallic frame is secured to and brought into electrical conduction with the bottom plate, or in which ground/mounting terminals which protrude in a direction opposite to "the substrate which has the antenna pattern which resonates at λ/4 formed thereon" are formed in the both end portions of the metallic frame and the terminals are passed through and soldered to the bottom plate.

In addition to including the structural requirement of the invention of either claim 1 or claim 3, a structure of a method of an invention of claim 7 includes a structural requirement in which a planar portion having a rectangular shape that is substantially the same as that of the substrate having the antenna pattern formed thereon is formed at the metallic frame, in which a portion of the planar portion near an end thereof is bent at a substantially right angle in order to form a standing wall portion and the substrate having the antenna pattern formed thereon is supported near an end of the standing wall portion, and in which the rectangular planar portion is bent at a substantially right angle along a long side thereof, so that a reinforcement edge which functions as a reinforcement rib is formed in order to prevent deformation of the planar portion.

In addition to including the structural requirement of the method of the invention of claim 1, a structure of a method of an invention of claim 8 includes a structural requirement in which the helical coil is wound and formed upon a circular cylindrical bobbin and the bobbin is mounted to the metallic frame, and wherein one end of the substrate having the antenna formed thereon is mounted to and supported by the metallic frame and a portion of the substrate near the other end is mounted to and supported by the bobbin.

A structure of a small low-posture antenna of claim 9 is that of an antenna which is tuned near a wavelength λ comprising a substrate having an antenna pattern which resonates at λ/4 formed thereon, a metallic frame mounted to one end of the substrate to support the substrate and connected to and brought into electrical conduction with the antenna pattern, a coil bobbin mounted to the metallic frame, a helical coil which is wound and formed upon the bobbin and which resonates at λ/4, and a coaxial cable which has a core wire connected to and brought into electrical conduction with one end of the helical coil and which has an external conductor connected to and brought into electrical conduction with the metallic frame, wherein the metallic frame is such as to be capable of being mounted to a bottom plate, and the other end of the helical coil and the antenna pattern oppose each other and are spaced from each other in order to provide capacitance therebetween.

In addition to including the structural requirement of the invention of claim 9, a structure of a small low-posture antenna of claim 10 includes a structural requirement in which, in means for connecting and bringing into electrical conduction the helical coil and an output end of a high-frequency circuit, the core wire of the coaxial cable is connected to and brought into electrical conduction with one end of the helical coil, and the external conductor is connected to and brought into electrical conduction with the metallic frame, and wherein the other end of the core wire of the coaxial cable is connected to the output end of the high-frequency circuit, and the external conductor is connected to the bottom plate of the high-frequency circuit.

A structure of a small low-posture antenna of an invention of claim 11 is that of an antenna which is tuned near a wavelength λ in which an antenna pattern which resonates at λ/4 is formed at one end of a surface of a substrate, in which an exciter pattern which resonates at λ/4 is formed near the other end of the substrate and both of the patterns are made to oppose each other and to be spaced from each other in order to provide capacitance therebetween, in which the substrate is supported by the metallic frame and the antenna pattern is connected to and brought into electrical conduction with the metallic frame, in which an external conductor of a coaxial cable is connected to and brought into electrical conduction with the metallic frame and a core wire of the coaxial cable is connected to and brought into electrical conduction with "a portion near an end portion situated at the opposite side of a portion where the exciter pattern opposes the antenna pattern" and in which the metallic frame is such as to be capable of being mounted to a bottom plate that is formed on a high-frequency circuit board.

In addition to including the structural requirement of the invention of claim 11, a structure of a small low-posture antenna of an invention of claim 12 includes a structural requirement in which, in means for connecting and bringing into electrical conduction the exciter pattern and a high-frequency circuit, the core wire of the coaxial cable is connected to and brought into electrical conduction with one end of the λ/4 exciter pattern and the external conductor is connected to and brought into electrical conduction with the metallic frame, and in which the other end of the core wire of the coaxial cable is connected to an output end of the high-frequency circuit and the external conductor is connected to the bottom plate of the high-frequency circuit.

In addition to including the structural requirement of the invention of claim 9 or claim 11, a structure of a small low-posture antenna of an invention of claim 13 includes a structural requirement in which the antenna pattern generally has a strip shape and has a rectangular or zigzag portion formed on the substrate, and in which the substrate is supported by the metallic frame, and a portion near the zigzag portion is connected to and brought into electrical conduction with the metallic frame.

In addition to including the structural requirement of the invention of claim 9 or claim 11, a structure of a small low-posture antenna of an invention of claim 14 includes a structural requirement in which the metallic frame has a portion that has a shape and size similar to those of the substrate, and in which, by mounting screws or mounting ground terminals, both end portions in a longitudinal direction of the portion similar to the substrate are mechanically secured to and are electrically in conduction with the bottom plate.

In addition to including the structural requirement of the invention of claim 9 or claim 11, a structure of a small low-posture antenna of an invention of claim 15 includes a structural requirement in which the metallic frame has a planar portion having a shape and a size that is similar to those of the strip-shaped substrate, in which a portion near an end in a longitudinal direction of the planar portion is bent at a substantially right angle to form a standing wall portion and the strip-shaped substrate is mounted and supported near an end of the standing wall portion, and in which an edge in the longitudinal direction of the planar portion is bent at a substantially right angle, so that the bent portion can function as a reinforcement rib which can prevent deformation of the planar portion.

In addition to including the structural requirement of the invention of claim 9, a structure of a small low-posture antenna of an invention of claim 16 includes a structural requirement in which an engaging hole or notch is formed in a planar portion of the metallic frame and an engaging protrusion is formed at one end surface of the bobbin, in which an engaging hole or notch is formed near an end in a longitudinal direction of the strip-shaped substrate and an engaging protrusion is formed at the other end surface of the bobbin, so that two pairs of "engaging hole or engaging notch and engaging protrusions" are formed, and in which, by rotating the bobbin around a centerline thereof, the two engaging pairs are such as to engage each other or disengage from each other at the same time.

A structure of a small low-posture antenna of an invention of claim 17 is that of an antenna which is tuned near a wavelength λ comprising a substrate which generally has a strip shape and which has a plate-shaped antenna pattern having a zigzag portion and resonating at λ/4 formed thereat; a metallic frame which supports the substrate by being mounted to one end in a longitudinal direction of the substrate, the metallic frame being connected and brought into electrical conduction near the zigzag portion of the plate-shaped antenna pattern; a coil bobbin mounted to the metallic frame; a helical coil which is wound and formed upon the bobbin and which resonates at λ/4; and a coaxial cable having a core wire connected to and brought into electrical conduction with one end of the helical coil and having an external conductor connected to and brought into electrical conduction with the metallic frame; wherein the metallic frame comprises:

a. a planar portion having substantially the same shape and size as the strip-shaped substrate and opposing the substrate so as to be substantially parallel thereto;

b. an extending portion which is adjacent to a long side of the strip-shaped planar portion and which extends along the same plane in a widthwise direction thereof;

c. a reinforcement edge formed by bending most of a peripheral portion of a rectangular plate-shaped portion, where the planar portion and the extending portion are integrally consecutively formed, in a direction opposite to the substrate; and d. a bottom plate mounting screw through hole formed in the extending portion;

wherein the other end of the helical coil and the plate-shaped antenna pattern are made to oppose each other and to be spaced from each other in order to provide capacitance therebetween.

BEST MODE FOR CARRYING OUT THE INVENTION

Figure 1:
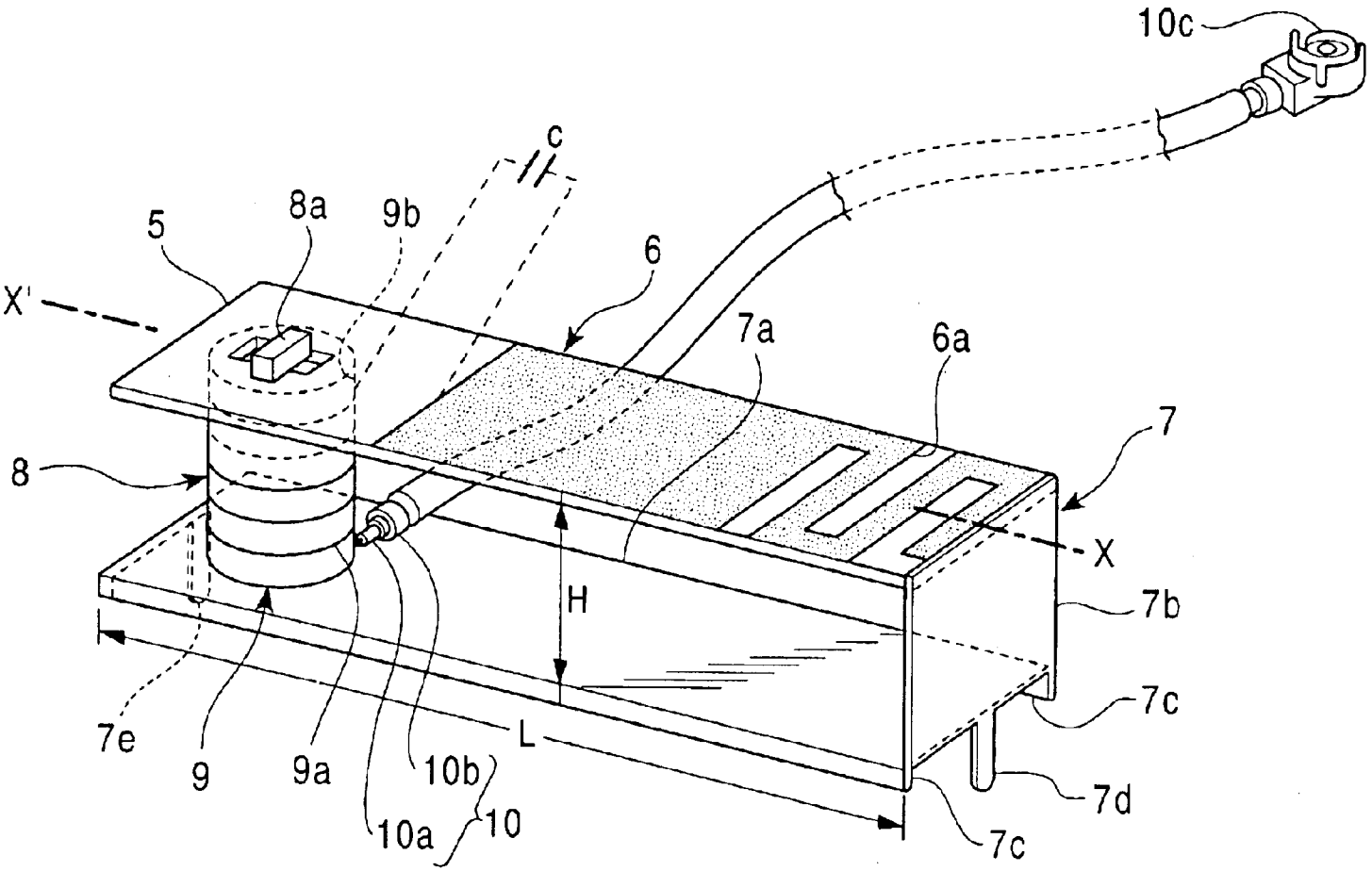
FIG. 1 is a schematic perspective view showing a first embodiment of the invention, corresponds to claims 1 and 6, and also illustrates the structures recited in claims 5 and 10.

FIG. 1 is a schematic perspective view showing a first embodiment of the invention, corresponds to claims 1 and 6, and also illustrates the structures recited in claims 5 and 10.

Reference numeral 5 denotes a strip-shaped substrate. In the present invention, a strip shape refers to a rectangular shape that is clearly externally different from a square shape and a shape similar to a rectangular shape.

An antenna pattern 6 that resonates at λ/4 is formed so as to cover most of one surface of the substrate 5. The antenna pattern 6 that resonates at λ/4 is disposed towards one side of the substrate surface in the longitudinal direction thereof.

Line X-X' is a centerline of the substrate 5 in the longitudinal direction thereof, and, in the embodiment, the antenna pattern 6 that resonates at λ/4 is disposed towards an X side, and an X'-side end portion is an area where there is no pattern.

A zigzag portion 6*a* is provided towards the side in the X-X' direction of the antenna pattern 6 that resonates at λ/4.

When the zigzag portion is provided in this way, it is possible to make the mechanical length of a plate-shaped antenna having an electrical length of λ/4 shorter than λ/4. However, when the zigzag portion is provided without paying enough attention, antenna performance (gain, tuning bandwidth) may be considerably deteriorated.

When, as in the present embodiment, the zigzag portion 6*a* is disposed towards the X side (a ground end side of the plate-shaped antenna), it is possible to reduce deterioration in antenna performance caused by the zigzag portion.

Reference numeral 7 denotes a metallic frame for supporting the substrate 5.

The metallic frame 7 has a planar portion 7*a* that has substantially the same shape and size as the substrate 5, is an important structural member from the viewpoint of the performance of the antenna, and has a standing wall portion 7*b* that is formed by bending substantially at a right angle one end of the metallic frame 7 in the longitudinal direction, with the X-side end of the substrate 5 being mounted to and supported by the top end of the standing wall portion 7*b*. Although, the method of mounting is not limited, a metallic film with a pattern on a surface of the substrate is soldered to the standing wall portion 7*b* in the embodiment. Reinforcement edges 7*c* are formed by bending two parallel longitudinal-direction sides of the planar portion 7*a* at a substantially right angle into the form of reinforcement ribs. It is desirable that the bending angles of the one end and the two sides of the metallic frame 7 be right angles. However, as long as a structure is a mechanically equivalent structure, any structure lies within the technical scope of the present invention even if the bending angles are not necessarily right angles.

Reference numerals 7*d* and 7*e* denote terminals that are formed by forming cuts in a sheet plate material of the metallic frame 7 and bending the cuts upward. The terminals 7*d* and 7*e* are inserted into a bottom plate that is provided on a circuit board (not shown) and are soldered thereto. By this, the metallic frame 7 is mechanically secured to the bottom plate, and is electrically integrally provided with the bottom plate.

As will be described later with reference to FIG. 2, the top and bottom end surfaces of a bobbin 8 are mounted to the substrate 5 and the planar portion 7*a* of the metallic frame, respectively. The bobbin 8 also functions as a support, and has a helical coil 9 which resonates at λ/4 wound thereupon.

A core wire 10*a* of a coaxial cable 10 is connected to a bottom end 9*a* of the helical coil 9, and an external conductor 10*b* thereof is connected to and is in electrical conduction with the metallic frame 7. A coaxial cable connector 10*c* is connected to the other end of the coaxial cable 10, and is connected to and is in electrical conduction with an output end of a high-frequency circuit (not shown).

By this, the bottom end 9*a* of the helical coil 9 becomes an input end, and the top end thereof becomes an output end 9*b*. Capacitance c is provided between the output end 9*b* and the aforementioned antenna pattern 6 that resonates at λ/4, the helical coil 9 functions as an exciter that resonates at λ/4, and the antenna pattern 6 that resonates at λ/4 exhibits excellent antenna characteristics such as those described later with reference to FIG. 5.

The antenna of the embodiment shown in FIG. 1 has a mechanical height H that is small, and a mechanical length L that is small, so that it is suitable as a built-in antenna of, for example, a mobile communication device.

In addition, since the structural members shown in FIG. 1 form one assembly, they are marketable. Therefore, for manufacturers that specialize in producing antennas, this is advantageous for practical purposes in terms of trade, counting, packaging, etc.

Figure 2:
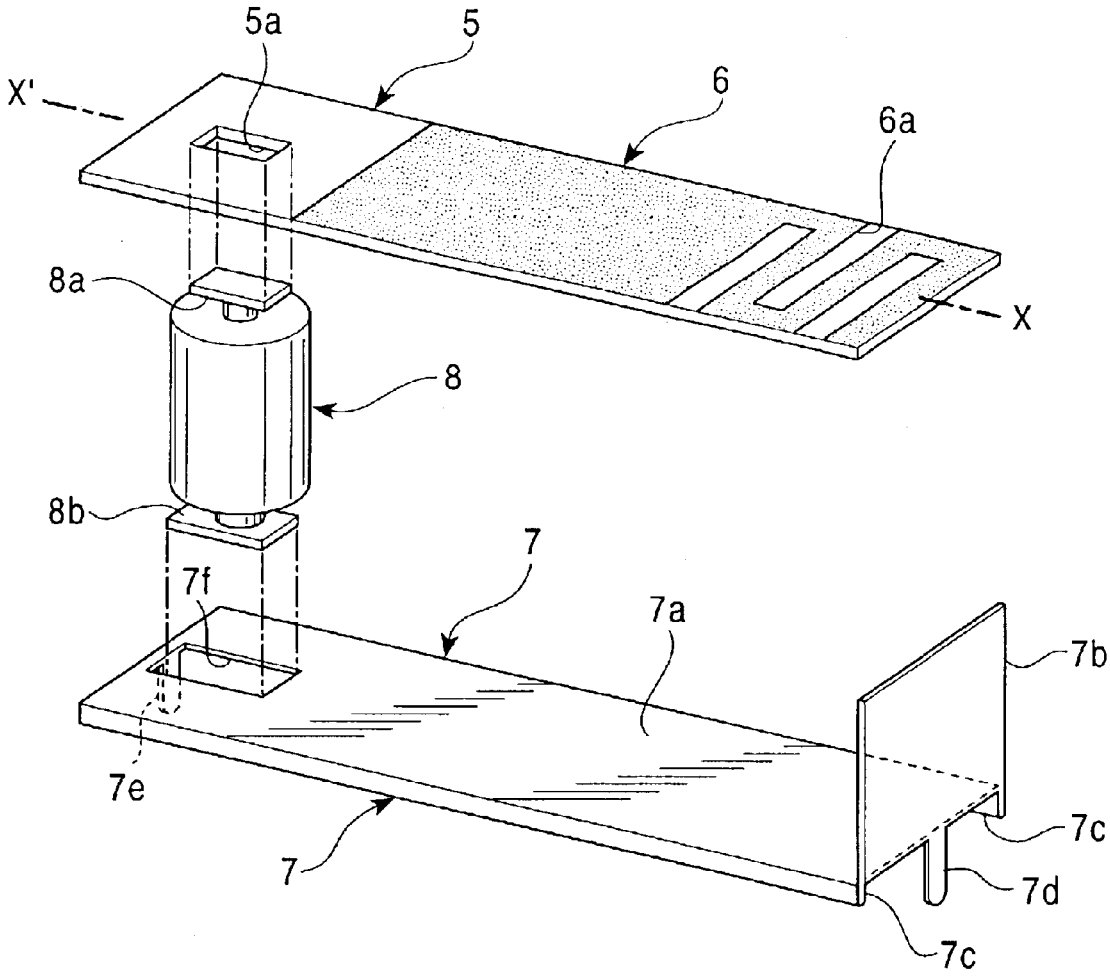
FIG. 2 is an exploded perspective view of the main portion of the embodiment shown in FIG. 1.

FIG. 2 is an exploded perspective view of the main portion of the embodiment shown in FIG. 1.

The standing wall portion 7*b* is formed at one end of the planar portion 7*a* of the metallic frame 7 (described before) in the longitudinal direction. An engaging hole 7*f* is formed near the other end thereof.

In correspondence to this, a bottom engaging protrusion 8*b* is provided at the bottom surface of the bobbin 8.

A top engaging protrusion 8*a* is provided at the top surface of the bobbin 8, and an engaging hole 5*a* which corresponds to this is provided near the X'-side end of the substrate 5.

In the case where the antenna is constructed in this way, when mounting the bobbin 8 and supporting the substrate 5 by the bobbin 8, complicated operations, such as bonding, do not need to be carried out, and a tapping structure and operation or a structure for and an operation of screwing and tightening screws are not required. Therefore, it is possible to quickly and easily mount the bobbin 8, and to detach it when necessary.

Figure 3:
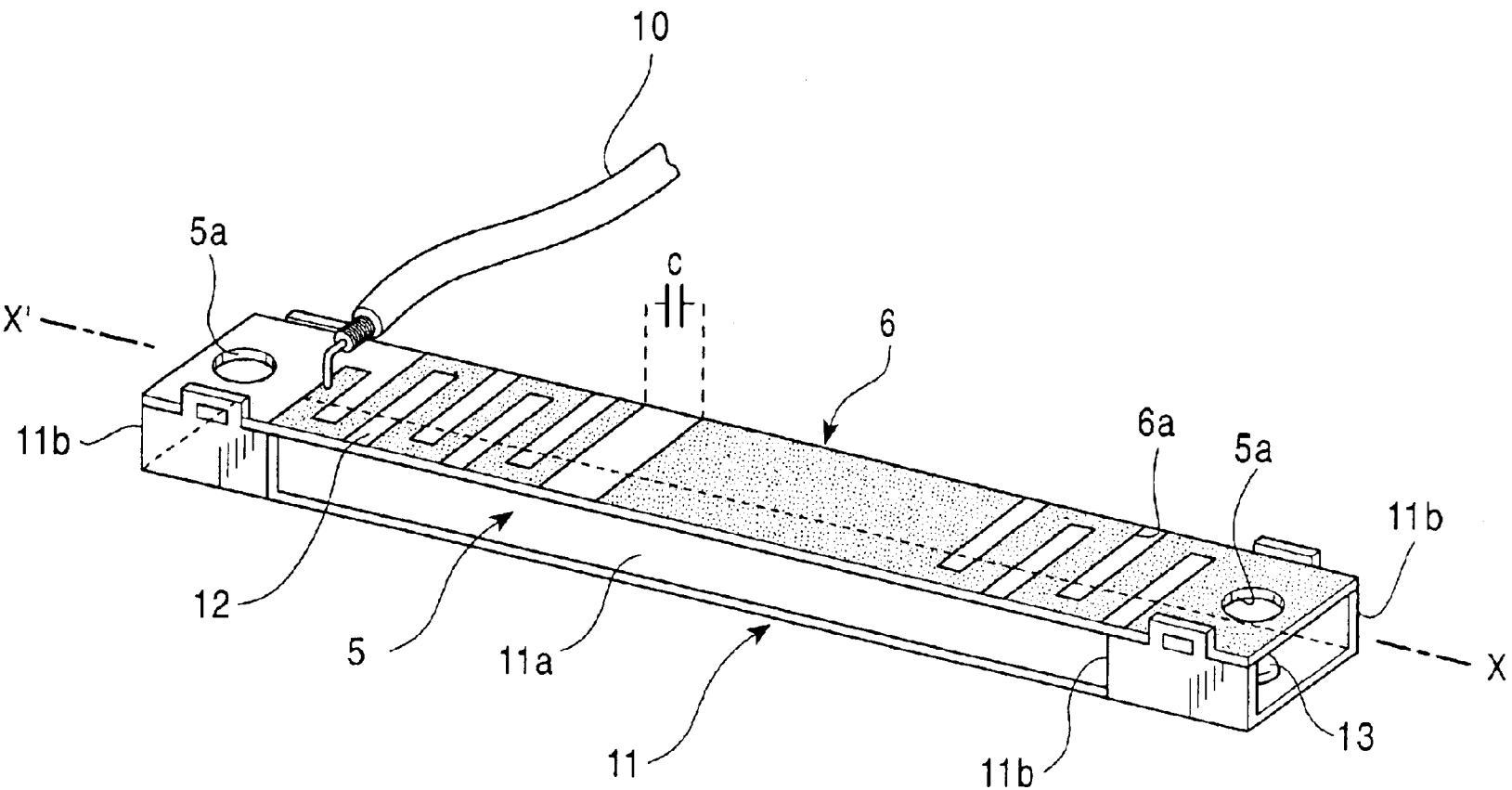
FIG. 3 is a schematic perspective view of an embodiment which differs from the embodiment shown in FIGS. 1 and 2.

FIG. 3 is a schematic perspective view of an embodiment that is different from the embodiment shown in FIGS. 1 and 2.

A substrate 5 used in this embodiment is a structural member that corresponds to the substrate 5 used in the previous embodiment, and is formed longer in an X-X' direction than the substrate 5 used in the previous embodiment.

An antenna pattern 6 which resonates at λ/4 and a zigzag portion 6*a* are provided towards an λ side of the substrate 5, which structure of this embodiment is the same as that of the previous embodiment.

Since the substrate 5 is long in the X-X' direction, a space where the antenna pattern 6 that resonates at λ/4 is not formed is formed towards an X' side. An exciter pattern 12 that resonates at λ/4 is formed at this space.

Capacitance c is provided at a location-where the λ/4 exciter pattern 12 and the antenna pattern 6 that resonates at λ/4 oppose each other.

Reference numeral 11 denotes a metallic frame for supporting the substrate 5, and has a planar portion 11*a* that has substantially the same shape and size as the substrate.

Standing wall portions 11*b* are provided near both ends of the planar portion 11*a* in the longitudinal direction thereof, respectively, and the substrate 5 is mounted and supported near the top edges of the standing wall portions 11*b*.

A core wire of a coaxial cable 10 is connected to an end of the λ/4 exciter pattern 12 situated opposite to "the side thereof that opposes the antenna pattern 6 that resonates at λ/4."

Although, in order to make it easier to read FIG. 3, the coaxial cable 10 is, in FIG. 3, schematically illustrated above the top surface of the substrate 5, the coaxial cable 10 that is actually used in the embodiment is routed between the bottom surface of the substrate 5 and the planar portion 11*a* of the metallic frame.

An external conductor of the coaxial cable 10 is connected to and is in electrical conduction with the metallic frame 11.

Next, mounting screw insertion holes 5*a* shown in FIG. 3 will be described with reference to FIG. 4.

Figure 4:
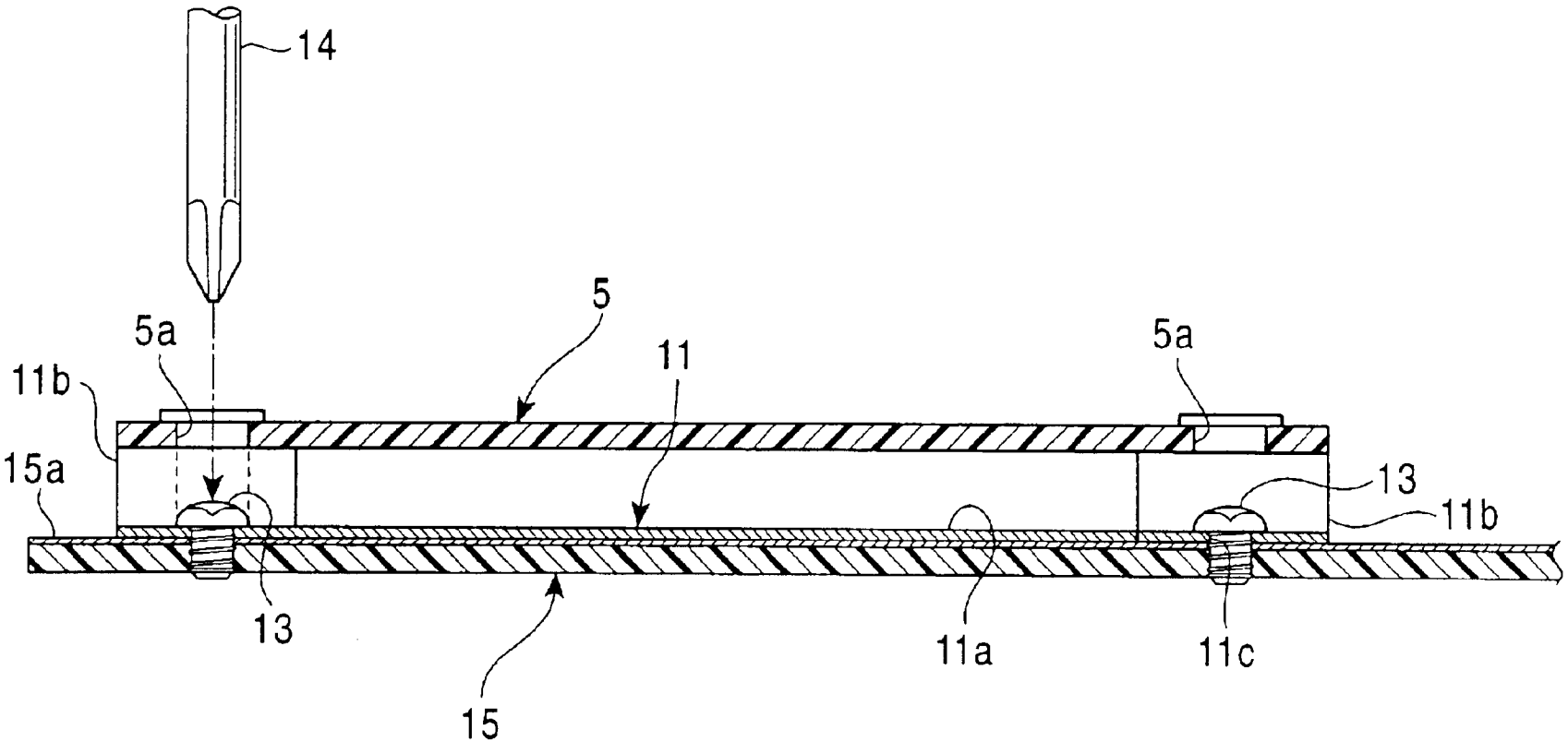
FIG. 4 is a vertical sectional view of the embodiment shown in FIG. 3.

FIG. 4 is a vertical sectional view of the embodiment shown in FIG. 3.

The metallic frame 11 that supports the substrate 5 is used by mounting the planar portion 11*a* thereof to a bottom plate 15*a*. The bottom plate 15*a* used in the embodiment is a member that is formed by depositing a film onto a surface of a circuit board 15 of a radio device (not shown).

Holes 11*c* are formed near both ends of the planar portion 11*a* of the metallic frame in the longitudinal direction thereof. By mounting screws 13 inserted in the holes 11*c*, the planar portion 11*a* of the metallic frame is brought in close contact with the bottom plate 15*a* in order to be mechanically secured to and made electrically integral with the bottom plate 15*a*.

In order to mount and tighten the mounting screws 13, the mounting screw insertion holes 5*a* are formed in the substrate 5. Reference numeral 14 denotes a driver.

As previously mentioned in the specification, the technology of the present invention is an improvement of the antenna technology in the earlier application that is not yet publicly known, so that, in a broad sense, the present invention relates to a Bluetooth antenna.

Since this type of antenna functions properly when there is sufficient grounded capacity, it is very important that the metallic frame be completely grounded. The mounting screws 13 shown in FIG. 4 and the ground/mounting terminals 7*d* and 7*e* shown in FIG. 2 are disposed at both ends of the planar portion of the metallic frame, respectively, so that the planar portion of the metallic frame is formed to function as complete ground.

Figure 5:
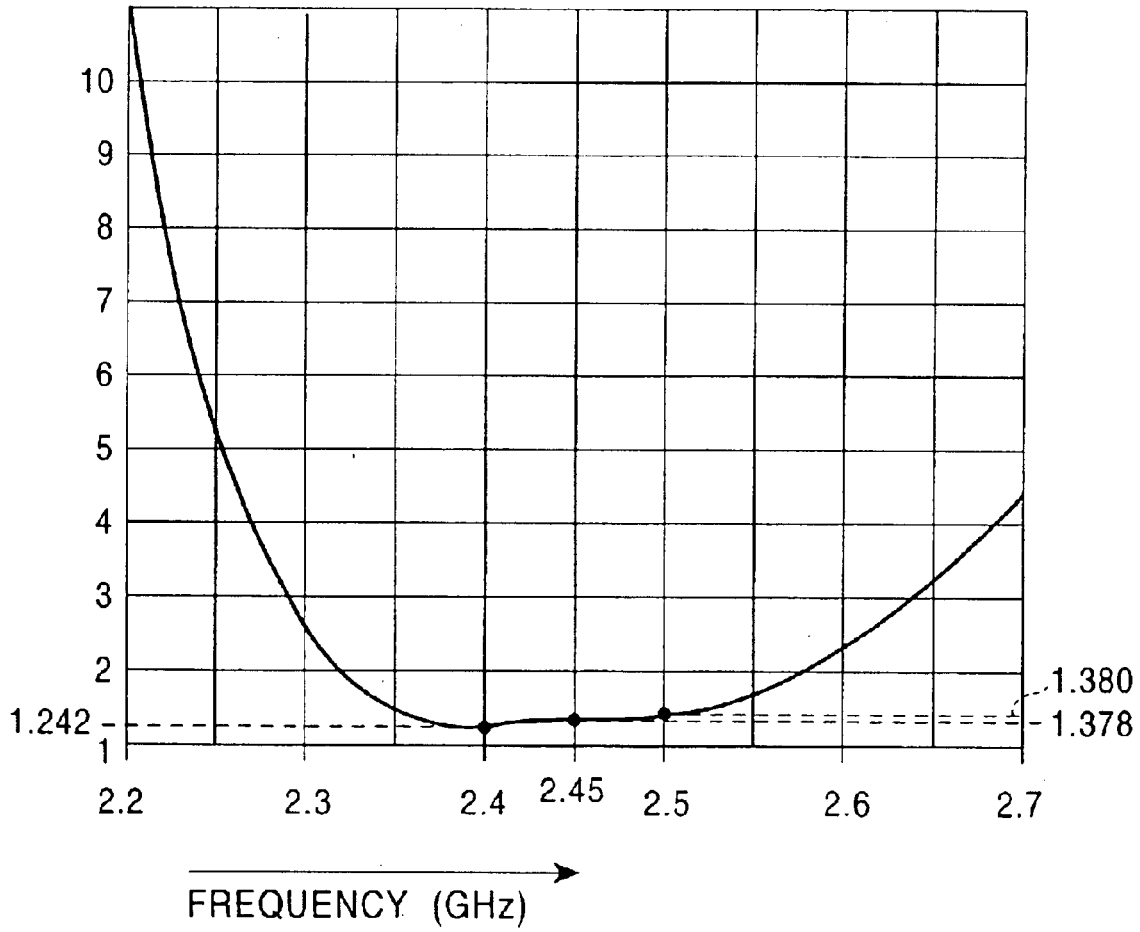
FIG. 5 is a graph of an SWR characteristic in the embodiment shown in FIG. 1.
Figure 6:
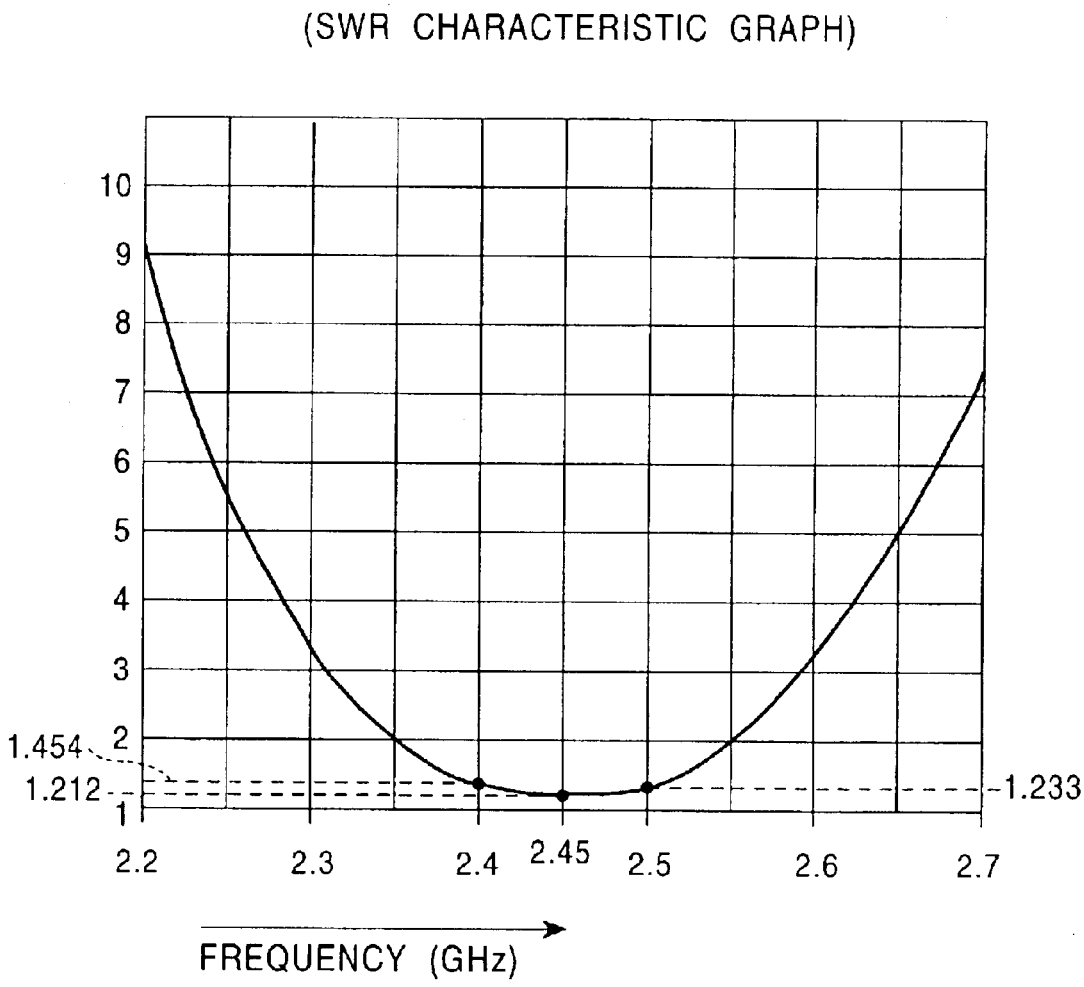
FIG. 6 is a graph of an SWR characteristic in the embodiment shown in FIG. 3.

FIG. 5 is a graph showing an SWR characteristic in the embodiment shown in FIG. 1, and FIG. 6 is a graph showing an SWR characteristic in the embodiment shown in FIG. 3. It can be seen that both embodiments provide excellent wideband characteristics near frequencies of a few giga cycles.

Figure 7:
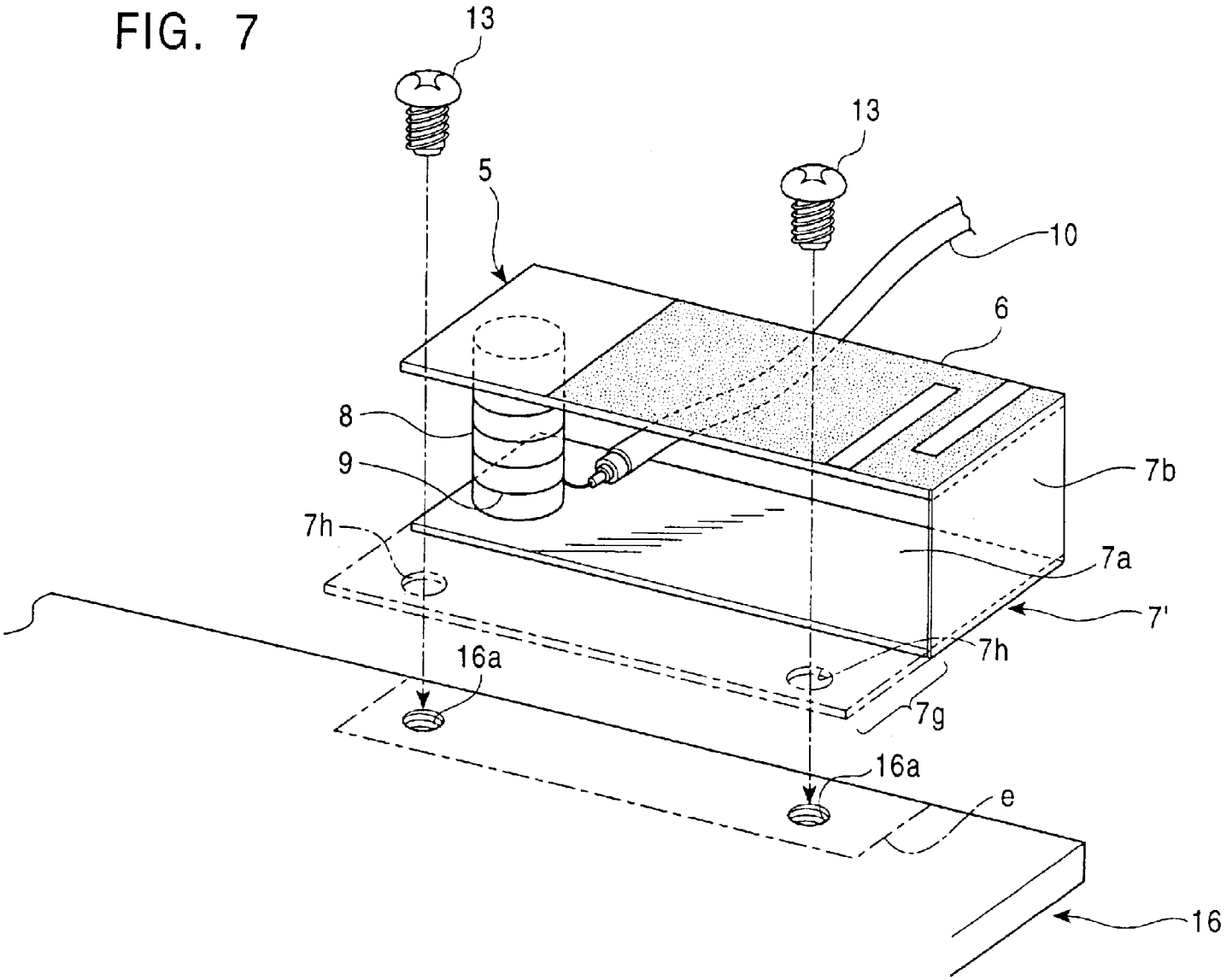
FIG. 7 is an exploded perspective view of a modification of the embodiment shown in FIG. 1.

FIG. 7 is a schematic perspective view of a modification of the embodiment shown in FIG. 1.

When an attempt is made to mount the antenna of the present invention to, for example, a bottom plate that is provided on a ready-made circuit board or a bottom plate that is built in a ready-made communications device, there may be cases where the ready-made circuit board does not provide enough area for mounting "the metallic frame of the antenna of the present invention." In such a case, as in a metallic frame 7' shown in FIG. 7. a mounting extending portion 7*g* which extends sideways from the planar portion 7*a* is formed, and through holes 7*h* used as threaded holes are formed in the extending portion 7*g*. Threaded holes 16*a* that correspond to the through holes 7*h* are formed in a bottom plate 16. The mounting screws 13 are inserted into the through holes 7*h* and are screwed into and tightened at the threaded holes 16*a*. By this, the antenna of the present invention can be installed on the bottom plate 16 by using an area e that is represented by a phantom line.

The bottom plate 16 used in the embodiment (FIG. 7) may be one formed by depositing a film on a circuit board or may be a single member formed of a sheet plate.

Figure 8:
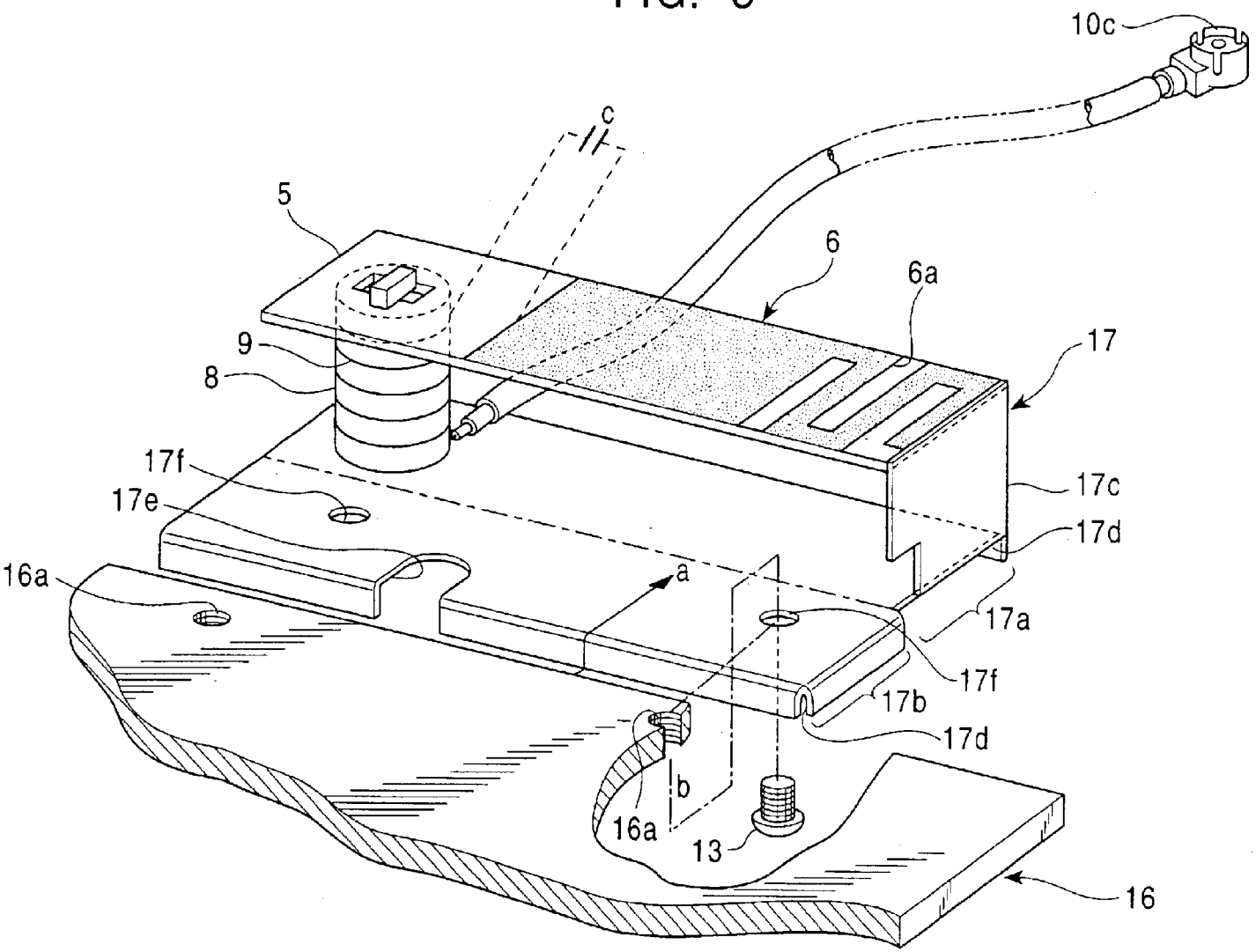
FIG. 8 is a schematic perspective view of an example of an improvement of the embodiment shown in FIG. 1.
Figure 9:
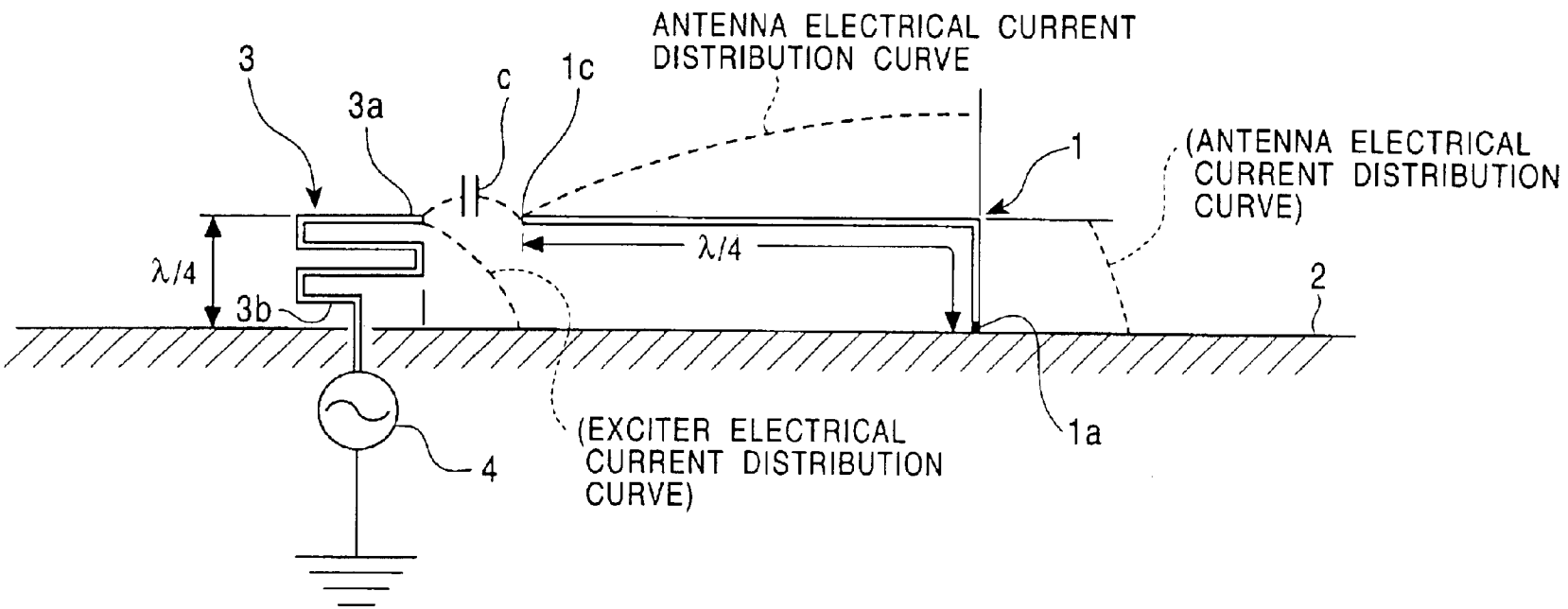
FIG. 9 is a schematic view for illustrating the principles of the invention of the earlier application that is not yet publicly known.

FIG. 8 illustrates an embodiment which is different from the above-described embodiments. This embodiment is an improvement of the embodiment shown in FIG. 1. A substrate 5, an antenna pattern 6 that resonates at $\lambda/4$, a bobbin 8, a helical coil 9, a coaxial cable connector 10*c*, and capacitance c are the same as or similar to those of the embodiment shown in FIG. 1.

A metallic frame 17 used in the embodiment (FIG. 8) is, in order to improve the mounted state of the frame with respect to a bottom plate 16, provided as a structural member that is an improvement of the metallic frame 7 used in the above-described embodiment (FIG. 1).

In the metallic frame 17, a planar portion 17*a* and an extending portion 17*b*, which oppose each other so as to be parallel to the substrate 5, are integrally and consecutively provided, and one end portion of the planar portion 17*a* is extended so as to be bent upward at a right angle in order to form a standing wall portion 17*c*.

The standing wall portion 17*c* is a structural member that corresponds to the standing wall portion 7*b* in the above-described embodiment (FIG. 1), and supports the substrate 5.

The planar portion 17*a* is formed with substantially the same shape and size as the strip-shaped substrate 5, and the extending portion 17*b* is formed adjacent to a long side of the planar portion 17*a* and with the same planar shape. It is desirable that the length of a long side of the extending portion 17*b* be substantially equal to the length of the planar portion 17*a*. Although the width of the extending portion 17*b* is not limited, it is appropriate to set the width thereof so that it is about the same as the width of the planar portion 17*a*.

As a result of forming the metallic frame as described above, the planar portion 17*a* and the extending portion 17*b* that are integrally consecutively provided form a substantially rectangular shape. Most of the peripheral portion of the rectangular shape is bent downward (that is, in a direction opposite to the substrate 5) in order to form reinforcement edges 17*d*. By providing the reinforcement edges 17*d*, the rigidity of the integrally formed planar portion 17*a* and the extending portion 17*b* is increased, so that they are not easily deformed. Therefore, antenna performance becomes stable, and, when they are mounted to the bottom plate 16 as described later, mechanical support becomes strong.

In the present invention, "most of the peripheral portion of the rectangular shape is bent downward in order to form reinforcement edges" also means that all of the peripheral portion is bent to form reinforcement edges, but the whole periphery does not have to be bent. Due to sheet plate molding, the portion of the metallic frame 17 where the standing wall portion 17*c* is bent upward does not have a reinforcement edge formed thereat.

A cutaway portion 17*e* is formed in order to prevent interference with structural portions that are not shown, and a reinforcement edge is not formed at this portion either. In FIG. 8, the cross sections of the reinforcement edges appear at the cutaway portion 17*e*, so that their shapes can be easily known.

Mounting screw through holes 17*f* are formed in the extending portion 17*b*.

The edges of the bottom plate 16 where mounting screw internally threaded holes 16*a* are formed are placed upon the extending portion 17*b* of the metallic frame as indicated by arrow a, and, after inserting mounting screws 13 into the through holes 17*f* as indicated by a bent arrow b, they are screwed into and tightened at the mounting screw internally threaded holes 16*a*.

When the metallic frame 17 is connected to the bottom plate 16 as shown in FIG. 8, the heads of the mounting screws 13 face downward. In other words, the heads do not bulge from the bottom plate 16 towards the antenna pattern 6 that resonate at $\lambda/4$. Therefore, the mounting screws 13 do not adversely affect the antenna performance.

As the structures and the functions have been made clear in the foregoing description by referring to embodiments of the present invention, according to the method of the invention of claim 1, a plate-shaped antenna pattern is formed on a surface of a substrate, and the antenna pattern is connected to a metallic frame, so that the antenna pattern can be easily positioned with precision.

In addition, by positioning a helical coil that operates as an antenna exciter with respect to the substrate, the helical coil can be positioned with respect to the antenna pattern.

Since the positioning can be easily carried out in this way, when antennas are industrially produced, uniformity in the qualities (in particular, antenna performance) of many products can be realized.

According to the method of the invention of claim 2, the small low-posture antenna of the invention of claim 1 can be easily and reliably electrically connected to a high-frequency circuit.

According to the method of the invention of claim 3, since a λ/4 antenna pattern and a λ/4 exciter pattern are formed on a surface of a substrate, it is possible to precisely restrict the relative positions of both of them, and to precisely position both patterns with respect to "a grounded metallic frame."

For this reason, when antennas are industrially produced, uniformity in the qualities (in particular, antenna performance) of many products can be maintained.

According to the method of the invention of claim 4, the small low-posture antenna of the invention of claim 3 can be easily and reliably electrically connected to a high-frequency circuit.

According to the method of the invention of claim 5, the small low-posture antenna of claim 1 or the small low-posture antenna of claim 3 can be made even shorter in length.

According to the method of the invention of claim 6, the metallic frame is reliably connected to and brought into electrical conduction with a bottom plate.

The performance of this type of antenna is such that the antenna can be practically used under the condition that it includes a satisfactory bottom plate. Therefore, in the inventions of claims 1 and 3 in which the metallic frame is a required structural member, the practical value of mechanically securing and electrically integrating the metallic frame to the bottom plate by applying claim 6 is considerable.

According to the method of the invention of claim 7, the levelness of a planar portion of the metallic frame with respect to the substrate is provided, and the positional relationship between the substrate and the planar portion is reliably restricted, so that good antenna performance is provided, and, in particular, when antennas are industrially produced, the uniformity in the qualities of many products is maintained.

According to the method of the invention of claim 8, both ends of the substrate and both ends of the planar portion of the metallic frame are reliably supported by a standing wall portion and a bobbin, so that good electrical performance thereof is maintained. In particular, when antennas are industrially produced, the uniformity (in particular, that of antenna performance) of many products is guaranteed.

According to the antenna of the invention of claim 9, a plate-shaped antenna pattern is formed on a substrate and the substrate is mounted to a metallic frame, while a helical coil is wound and formed upon a bobbin that is mounted to the metallic frame and the helical coil acts as an exciter. Therefore, the plate-shaped antenna and the exciter (helical coil) can be easily positioned with respect to each other, so that they will not go wrong during use. Due to the same reason, when antennas are industrially produced, the uniformity in the qualities (in particular, antenna performance) of many products is good.

According to the invention of claim 10, the small low-posture antenna of the invention of claim 9 can be easily and reliably electrically connected to a high-frequency circuit.

When the invention of claim 11 is applied, a λ/4 antenna pattern and a λ/4 exciter pattern are formed on a common substrate (5), so that it is possible to easily restrict the relative positions of both of them with high precision, and to, when antennas are industrially produced, guarantee the uniformity in the qualities (in particular, antenna performances) of many products.

According to the antenna of the invention of claim 12, the small low-posture antenna of claim 11 can be easily and reliably electrically connected to a high-frequency circuit.

According to the antenna of the invention of claim 13, the small low-posture antenna of claim 9 or the small low-posture antenna of claim 11 can be made even shorter in length.

According to the antenna of the invention of claim 14, the portion of the metallic frame opposing the substrate (that is, the surface facing the plate-shaped antenna pattern) is reliably secured to and electrically made integral with the bottom plate. When a sufficient bottom plate capacitance that is provided as described above is provided, the λ/4 antenna pattern exhibits good antenna characteristics.

According to the antenna of the invention of claim 15, the levelness of the portion of the metallic frame that opposes the substrate is maintained, and the interval between the opposing portions is restricted, so that desired antenna characteristics (high gain/wideband characteristics) can be stably provided.

According to the invention of claim 16, by making the bobbin of the helical coil that functions as an exciter also "play the role of supporting the substrate with respect to the metallic frame," it is possible to obtain a simple and strong frame-like structure, to maintain stable antenna performance, to achieve good bobbin assembly efficiency, and to quickly and easily mount the bobbin.

According to the antenna of the invention of claim 11, a plate-shaped antenna pattern is formed on a substrate and the substrate is mounted to a metallic frame, while a helical coil is wound and formed upon a bobbin that is mounted to the metallic frame and the helical coil functions as an exciter. Therefore, the plate-shaped antenna and the exciter (helical coil) can be easily positioned with respect to each other, so that they will not go wrong during use.

In addition, a bottom plate is such as to be mounted to an extending portion of the metallic frame, and reinforcement edges are formed at the peripheral portion of a rectangular plate-shaped member formed by integrally forming a planar portion and the extending portion of the metallic frame. Therefore, the planar portion that functions as ground and that opposes the antenna pattern does not easily get deformed, and is, thus, reliably and firmly secured to a bottom plate. For this reason, the working efficiency with which the antenna is installed to a radio communications device is good, and antenna performance is stable. Even if a shock is exerted on a radio communications device when, for example, a person drops it by mistake while holding it, there is no possibility of the radio communications device breaking or not staying in adjustment.

What is claimed is:

1. A method for forming a small low-posture antenna which is tuned near a wavelength λ, wherein an antenna pattern which resonates at λ/4 is formed on a surface of a substrate, wherein the substrate is made to oppose and is supported with respect to a planar portion of a metallic frame, wherein a helical coil which resonates at λ/4 is supported by the metallic frame, wherein one end of the antenna pattern is connected to and is brought into electrical conduction with the metallic frame, and wherein one end of the helical coil and one end of the antenna pattern are made to oppose each other in order to provide capacitance and the other end of the helical coil is connected to an output end of a high-frequency circuit in order to make the helical coil act as an antenna exciter.

2. A method for forming a small low-posture antenna according to claim 1, wherein, in means for connecting and bringing into electrical conduction the helical coil and the output end of the high-frequency circuit, a core wire of a coaxial cable is connected to and brought into electrical conduction with one end of the helical coil, and an external conductor is connected to and brought into electrical conduction with the metallic frame, and wherein the other end of the core wire of the coaxial cable is connected to the output end of the high-frequency circuit, and the external conductor is connected to a bottom plate of the high-frequency circuit.

3. A method for forming a small low-posture antenna which is tuned near a wavelength λ, wherein an antenna pattern which resonates at λ/4 is formed at one end of a surface of a substrate, wherein an exciter pattern which resonates at λ/4 is formed near the other end of the substrate, wherein the antenna pattern and the exciter pattern are made to oppose each other and to be spaced from each other in order to provide capacitance therebetween, wherein the substrate is supported by a metallic frame having a planar portion that opposes the substrate, and wherein one end of the exciter pattern is connected to an output end of a high-frequency circuit.

4. A method for forming a small low-posture antenna according to claim 3, wherein, in means for connecting and bringing into electrical conduction the exciter pattern and the high-frequency circuit, a core wire of a coaxial cable is connected to and brought into electrical conduction with one end of the λ/4 exciter pattern and an external conductor is connected to and brought into electrical conduction with the metallic frame, and wherein the other end of the core wire of the coaxial cable is connected to the output end of the high-frequency circuit and the external conductor is connected to a bottom plate of the high-frequency circuit.

5. A method for forming a small low-posture antenna according to either claim 1 or claim 3, wherein the antenna pattern generally has a strip shape and has a rectangular or zigzag portion formed on the substrate, and wherein the substrate is supported by the metallic frame, and a portion near the zigzag portion is connected to and brought into electrical conduction with the metallic frame.

6. A method for forming a small low-posture antenna according to either claim 1 or claim 3, wherein holes for inserting mounting screws are provided in both end portions of the metallic frame and the mounting screws that have been inserted into the holes are screwed into the bottom plate, so that the metallic frame is secured to and brought into electrical conduction with the bottom plate, or wherein ground/mounting terminals which protrude in a direction opposite to "the substrate which has the antenna pattern which resonates at λ/4 formed thereon" are formed in the both end portions of the metallic frame and the terminals are passed through and soldered to the bottom plate.

7. A method for forming a small low-posture antenna according to either claim 1 or claim 3, wherein a planar portion having a rectangular shape that is substantially the same as that of the substrate having the antenna pattern formed thereon is formed at the metallic frame, wherein a portion of the planar portion near an end thereof is bent at a substantially right angle in order to form a standing wall portion and the substrate having the antenna pattern formed thereon is supported near an end of the standing wall portion, and wherein the rectangular planar portion is bent at a substantially right angle along a long side thereof, so that a reinforcement edge which functions as a reinforcement rib is formed in order to prevent deformation of the planar portion.

8. A method for forming a small low-posture antenna according to claim 1, wherein the helical coil is wound and formed upon a circular cylindrical bobbin and the bobbin is mounted to the metallic frame, and wherein one end of the substrate having the antenna formed thereon is mounted to and supported by the metallic frame and a portion of the substrate near the other end is mounted to and supported by the bobbin.

9. A small low-posture antenna which is tuned near a wavelength λ comprising a substrate having an antenna pattern which resonates at λ/4 formed thereon, a metallic frame mounted to one end of the substrate to support the substrate and connected to and brought into electrical conduction with the antenna pattern, a coil bobbin mounted to the metallic frame, a helical coil which is wound and formed upon the bobbin and which resonates at λ/4, and a coaxial cable which has a core wire connected to and brought into electrical conduction with one end of the helical coil and which has an external conductor connected to and brought into electrical conduction with the metallic frame, wherein the metallic frame is such as to be capable of being mounted to a bottom plate, and the other end of the helical coil and the antenna pattern oppose each other and are spaced from each other in order to provide capacitance therebetween.

10. A small low-posture antenna according to claim 9, wherein, in means for connecting and bringing into electrical conduction the helical coil and an output end of a high-frequency circuit, the core wire of the coaxial cable is connected to and brought into electrical conduction with one end of the helical coil, and the external conductor is connected to and brought into electrical conduction with the metallic frame, and wherein the other end of the core wire of the coaxial cable is connected to the output end of the high-frequency circuit, and the external conductor is connected to the bottom plate of the high-frequency circuit.

11. A small low-posture antenna which is tuned near wavelength λ, wherein an antenna pattern which resonates at λ/4 is formed at one end of a surface of a substrate, wherein an exciter pattern which resonates at λ/4 is formed near the other end of the substrate and both of the patterns are made to oppose each other and to be spaced from each other in order to provide capacitance therebetween, wherein the substrate is supported by the metallic frame and the antenna pattern is connected to and brought into electrical conduction with the metallic frame, wherein an external conductor of a coaxial cable is connected to and brought into electrical conduction with the metallic frame and a core wire of the coaxial cable is connected to and brought into electrical conduction with "a portion near an end portion situated at the opposite side of a portion where the exciter pattern opposes the antenna pattern," and wherein the metallic frame is such as to be capable of being mounted to a bottom plate that is formed on a high-frequency circuit board.

12. A small low-posture antenna according to claim 11, wherein, in means for connecting and bringing into electrical conduction the exciter pattern and a high-frequency circuit, the core wire of the coaxial cable is connected to and brought into electrical conduction with one end of the λ/4 exciter pattern and the external conductor is connected to and brought into electrical conduction with the metallic frame, and wherein the other end of the core wire of the coaxial cable is connected to an output end of the high-frequency circuit and the external conductor is connected to the bottom plate of the high-frequency circuit.

13. A small low-posture antenna according to either claim 9 or claim 11, wherein the antenna pattern generally has a strip shape and has a rectangular or zigzag portion formed on the substrate, and wherein the substrate is supported by the metallic frame, and a portion near the zigzag portion is connected to and brought into electrical conduction with the metallic frame.

14. A small low-posture antenna according to either claim 9 or claim 11, wherein the metallic frame has a portion that has a shape and size similar to those of the substrate, and wherein, by mounting screws or mounting ground terminals, both end portions in a longitudinal direction of the portion similar to the substrate are mechanically secured to and are electrically in conduction with the bottom plate.

15. A small low-posture antenna according to either claim 9 or claim 11, wherein the metallic frame has a planar portion having a shape and a size that is similar to those of the strip-shaped substrate, wherein a portion near an end in a longitudinal direction of the planar portion is bent at a substantially right angle to form a standing wall portion and the strip-shaped substrate is mounted and supported near an end of the standing wall portion, and wherein an edge in the longitudinal direction of the planar portion is bent at a substantially right angle, so that the bent portion can function as a reinforcement rib which can prevent deformation of the planar portion.

16. A small low-posture antenna according to claim 9, wherein an engaging hole or notch is formed in a planar portion of the metallic frame and an engaging protrusion is formed at one end surface of the bobbin, wherein an engaging hole or notch is formed near an end in a longitudinal direction of the strip-shaped substrate and an engaging protrusion is formed at the other end surface of the bobbin, so that two pairs of "engaging hole or engaging notch and engaging protrusions" are formed, and wherein, by rotating the bobbin around a centerline thereof, the two engaging pairs are such as to engage each other or disengage from each other at the same time.

17. A small low-posture antenna which is tuned near a wavelength λ comprising a substrate which generally has a strip shape and which has a plate-shaped antenna pattern having a zigzag portion and resonating at λ/4 formed thereat; a metallic frame which supports the substrate by being mounted to one end in a longitudinal direction of the substrate, the metallic frame being connected and brought into electrical conduction near the zigzag portion of the plate-shaped antenna pattern; a coil bobbin mounted to the metallic frame; a helical coil which is wound and formed upon the bobbin and which resonates at λ/4; and a coaxial cable having a core wire connected to and brought into electrical conduction with one end of the helical coil and having an external conductor connected to and brought into electrical conduction with the metallic frame; wherein the metallic frame comprises:

a. a planar portion having substantially the same shape and size as the strip-shaped substrate and opposing the substrate so as to be substantially parallel thereto;

b. an extending portion which is adjacent to a long side of the strip-shaped planar portion and which extends along the same plane in a widthwise direction thereof;

c. a reinforcement edge formed by bending most of a peripheral portion of a rectangular plate-shaped portion, where the planar portion and the extending portion are integrally consecutively formed, in a direction opposite to the substrate; and d. a bottom plate mounting screw through hole formed in the extending portion;

wherein the other end of the helical coil and the plate-shaped antenna pattern are made to oppose each other and to be spaced from each other in order to provide capacitance therebetween.

* * * * *